United States Patent [19]

Bell et al.

[11] Patent Number: 4,945,701

[45] Date of Patent: Aug. 7, 1990

[54] COMPOSITE CONCRETE FLOOR PANEL

[75] Inventors: Jonathan Bell, Ellicott City; Peter Blacklin, Columbia, both of Md.

[73] Assignee: Tate Access Floors, Inc., Jessup, Md.

[21] Appl. No.: 352,488

[22] Filed: May 16, 1989

[51] Int. Cl.[5] ..... E04B 5/04

[52] U.S. Cl. ..... 52/601; 264/86

[58] Field of Search ..... 52/596, 601

[56] References Cited

U.S. PATENT DOCUMENTS

| | | |
|---|---|---|
| 1,845,711 | 2/1932 | Honig et al. . |
| 2,438,528 | 3/1948 | Wilhelm et al. . |
| 2,673,373 | 3/1954 | Heuer . |
| 2,764,887 | 10/1956 | D'Ambly . |
| 2,839,812 | 6/1958 | Berliner . |
| 3,002,247 | 10/1961 | Dettling et al. . |
| 3,100,677 | 8/1963 | Frank et al. . |
| 3,242,889 | 3/1966 | Thomas, Sr. . |
| 3,396,453 | 8/1968 | Thomas, Sr. . |
| 3,759,009 | 9/1973 | Ransome . |
| 3,880,979 | 4/1975 | Hemingway . |
| 3,952,402 | 4/1976 | Mengeringhausen . |
| 4,124,960 | 11/1978 | Bush et al. . |
| 4,132,043 | 1/1979 | Juba . |
| 4,203,714 | 5/1980 | Wenander . |
| 4,251,970 | 2/1981 | Home . |
| 4,447,998 | 5/1984 | Griffin . |
| 4,606,156 | 8/1986 | Sweers et al. . |
| 4,639,204 | 1/1987 | Munsey et al. . |
| 4,729,859 | 3/1988 | Munsey et al. . |
| 4,730,805 | 3/1988 | Yokota et al. . |
| 4,746,481 | 5/1988 | Schmidt . |
| 4,784,821 | 11/1988 | Leopold . |
| 4,787,597 | 11/1988 | Yokota et al. . |

OTHER PUBLICATIONS

Fielding & Platt Limited Brochure Entitled: "Fielding Hydraulic Concrete Presses"; 13 pages.

Fielding & Platt Limited Brochure Entitled: "Precast Concrete Paving Products"; 6 pages.

*Primary Examiner*—Carl D. Friedman

*Attorney, Agent, or Firm*—Oblon, Spivak, McClelland, Maier & Neustadt

[57] ABSTRACT

Disclosed is a panel which includes a pan having at least one side member with an upper edge portion, the pan having contained therein a fluid based cementitious material pressed for removal of water while within the pan, and at least one trim member attached to the upper edge portion of the side member of the pan, the trim member undergoing telescoping action upon pressing of the material in the pan so as to be rigidly secured to the upper edge portion of the side member of the pan. Also disclosed is an apparatus and process for production of the pan.

5 Claims, 6 Drawing Sheets

COMPOSITE CONCRETE FLOOR PANEL

BACKGROUND OF THE INVENTION

1. Field of the Invention

The present invention is directed to a floor panel which is filled with a fluid based cementitious material and an apparatus and process for making a floor panel which has a pan made of steel or other suitable material which is filled with the cementitious material. The apparatus and process utilize the principal of forced removal of excess water (i.e., de-watering) to adjust the volume of the cementitious material to exactly fill the pan.

2. Discussion of the Background

Access floor panels are typically on the order of 2 feet square and from 1 to 1½ inches thick. In order to eliminate gaps and unevenness, the panels must be made to close tolerances. Access floor panels are currently manufactured utilizing a concrete-filled galvanized steel pan configuration. The most common practice is to fill the pan to excess, allowing the concrete to partially cure, and then surface grinding the panel to a finished dimension as shown in FIG. 1. This requires the use of a belt grinder 1 and a sanding belt 2 which contacts the steel edge of the pan 4 and grinds the concrete 6. Grinding the steel of the pan 4 is not desirable because the galvanizing is removed leaving the steel unprotected. Alternate manufacturing methods such as injecting the concrete into a closed capacity mold containing the pan, as shown in FIG. 2, have been of limited success, particularly since the concrete 6 does not easily flow through the small sections common in access floor panels.

An example of an apparatus and method for forming a composite structural panel is shown in U.S. Pat. No. 3,952,402 to Mengeringhausen. This discloses a process of compacting concrete in a closed cavity. A more advantageous method and apparatus for the production of composite structural panels is desired, however.

The process of de-watering concrete is known, as exemplified by the prior art device shown in FIG. 2. In this example, slabs 8 of concrete having a dimension of, for example, 2"×20"×30"× are regularly manufactured by compressing concrete 6 in a mold 10 and forcing the excess water 12 out through a filter media 14, which is attached to a lower portion 16 of a perforated top press head plate 18, which is then pressed against the upper surface 20 of the concrete 6 in the mold 10. The result is the slab 8, which is sufficiently rigid to stand on end for curing. The performance requirements of most access floor installations may be met with a composite panel of light weight aggregate concrete and commercial quality steel. The required thickness of the panel would be just over an inch depending on whether any additional reinforcement is necessary. The pan, prior to being filled, is typically fairly formable and flexible.

The use of hydraulic concrete presses is also known, as exemplified by the Fielding and Platt, Ltd., brochure entitled "Fielding Hydraulic Concrete Presses". The process shown therein consists of filling a mold with a wet mix concrete and then applying pressure until excess water has been expelled and compaction is complete. A discussion is also set forth regarding concrete products in the article by Alan Lilley, entitled "Precast Concrete Paving Products", a brochure published by Fielding and Platt, Ltd.

The foregoing procedures are all characterized by certain drawbacks or deficiencies in the manufacturing process, which have not allowed panels of required tolerances to yet be available. The disadvantage of leakage of material from the panel when being processed and the need for protecting the edge of the panel from chipping during handling and use has resulted in Applicants' directed research to solve these problems.

The prior art has also been characterized by having uneven transition between edges of adjacent panels. These edges have been of low durability, and this has therefore led to the edges chipping when a load is rolled over the panels.

An apparatus and process has also been sought for the purpose of minimizing manufacturing tolerances in pressing operations so as to allow for a tight fit of the pan in the mold.

There has also been a desire to manufacture floor panels which have trim members which help to secure the concrete within the pan, which allows for post machining of the panel, if needed, and which provides an aesthetically pleasing edge portion, which also resists chipping either during or after installation of an access floor system.

SUMMARY OF THE INVENTION

An object of the present invention is to provide an improved de-watered cementitious steel pan composite panel and to provide an apparatus and method for making the panel so as to avoid the drawbacks of the prior art.

A further object of the invention is to provide a floating mold process for improving the procedure by which floor panels can be produced.

An additional object is to provide an improved panel having a telescoping trim member which telescopes during pressing operation for effectively securing the trim member to an upper edge portion of a side member of the panel. This trim serves to seal the edge of the panel during the pressing procedure to prevent leakage of the cementitious material from the pan and to protect the edge of the panel from chipping during handling and use.

A yet further object of the invention is to provide a panel which includes a pan having at least one side member with an upper edge portion, the pan having contained therein a fluid based cementitious material which has been pressed for removal of a predetermined fluid, such as water, while within the pan, and at least one telescoping trim member, attached to the upper edge portion of the side member of the pan, the trim member undergoing telescoping action upon pressing of the material in the pan, so as to be rigidly secured to the upper edge portion of the side member of the pan.

The present invention also serves to provide an apparatus for producing a pan filled with a fluid based cementitious material, the apparatus including a mold support platform or table, a mold within which the pan is positioned, a mechanism for resiliently mounting the mold on the mold support platform or table, a mold support member upon which the mold is positioned, and a press head for engaging the mold and pressing the mold toward the mold support member and for removing the fluid from the cementitious material in the pan.

The present invention is also characterized by providing a process for producing a concrete filled panel, which includes the steps of positioning a pan filled with a fluid based cementitious material in a mold, resiliently supporting the mold on a support table, and pressing the mold and the pan downwardly while simultaneously removing the fluid from the material in the pan.

BRIEF DESCRIPTION OF THE DRAWINGS

Various other objects, features and attendant advantages of the present invention will be more fully appreciated as the same becomes better understood from the following detailed description when considered in connection with the accompanying drawings in which like references characters designate like or corresponding parts throughout the several views and wherein.

DESCRIPTION OF THE PREFERRED EMBODIMENTS

Figure 1:
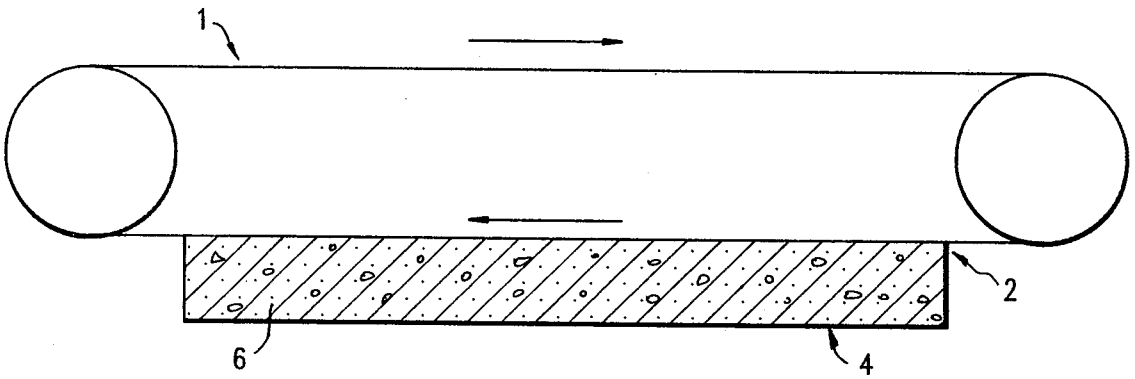
FIG. 1 PRIOR ART
FIG. 1 discloses a prior art method and apparatus of manufacturing a concrete-filled galvanized steel pan floor panel.
Figure 2:
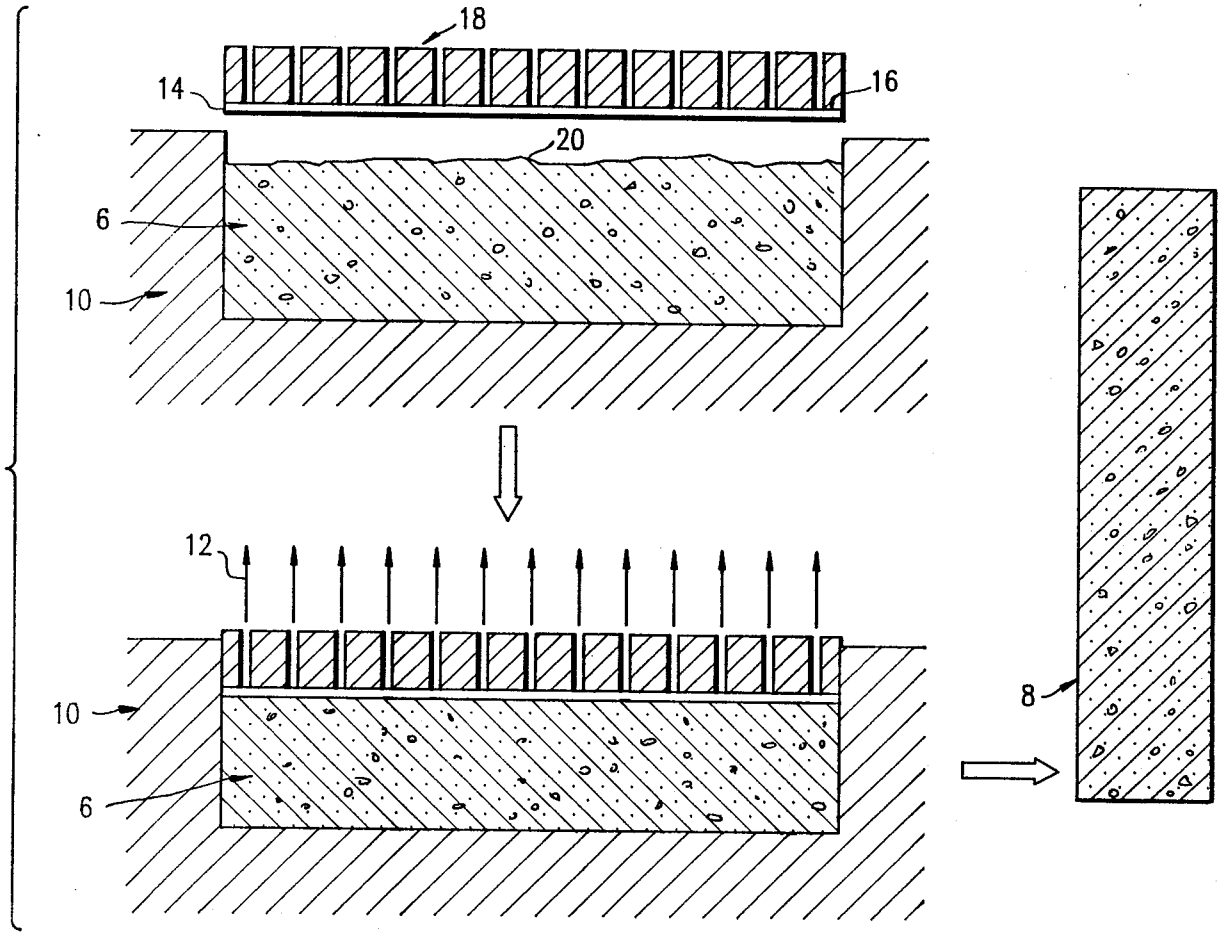
FIG. 2 PRIOR ART
FIG. 2 discloses a prior art method and apparatus for compressing and de-watering concrete in a mold.
Figure 3:
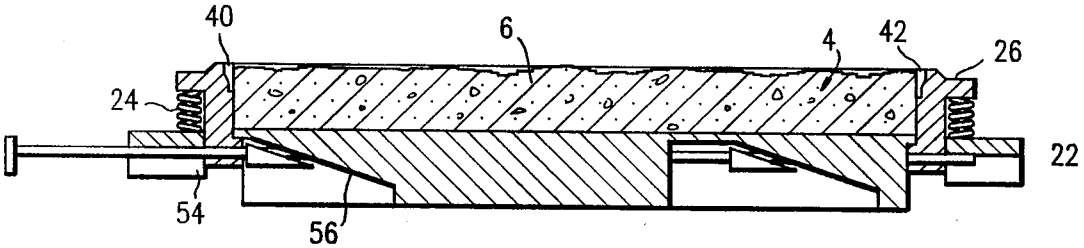
FIG. 3 discloses an apparatus for producing a pan filled with a water based cementitious material in accordance with the present invention.

The first embodiment of the present invention is shown in FIGS. 1-9. In particular, FIGS. 3-6 serve to show each of the steps utilized in accordance with the process for producing a panel which contains a fluid (e.g. water) based cementitious material. The apparatus includes a mold supporting platform or table 22 which may be fixed in place or rotatable for transferring the mold 10 through various stages. In the stage shown in FIG. 3, a fluid based cementitious material 6, such as concrete, gypsum or similar material, typically referred to as a "wet mix", is positioned within the performed floor panel pan 4 which is made of steel or other metal or similarly sturdy material, including plastic, which is placed within the mold 10. The steel may be galvanized for greater protection against rusting. The pan 4 is of a relatively light gauge so as to be deformable for shaping and for subsequent insertion within the mold. The mold is supported on the mold supporting platform or table 22 by a resilient member such as mold support springs 24. As an alternative to the springs 24, a hydraulic system or other structural support system can be used which is resilient, meaning that this member allows the flange portion 26 of the mold to be movable downward or upward in a direction towards an associated mold support such as the mold support platform or table 22 during pressing operation. A press head plate 28 for the press head is utilized, which plate contains a plurality of apertures 30 formed therein which allows excess fluid to escape therethrough during pressing operation. A conventional filter media 32 can be placed on the bottom edge portion 34 of the press head plate 28 prior to pressing operation.

The steel pan 4 is supported by a packer plate 36 which is in turn supported by a press bolster 38. Upon downward movement of the press head plate 28, the same engages with the upper edge portions 40 of the mold for biasing the mold 10 in a downward direction.

Figure 9:
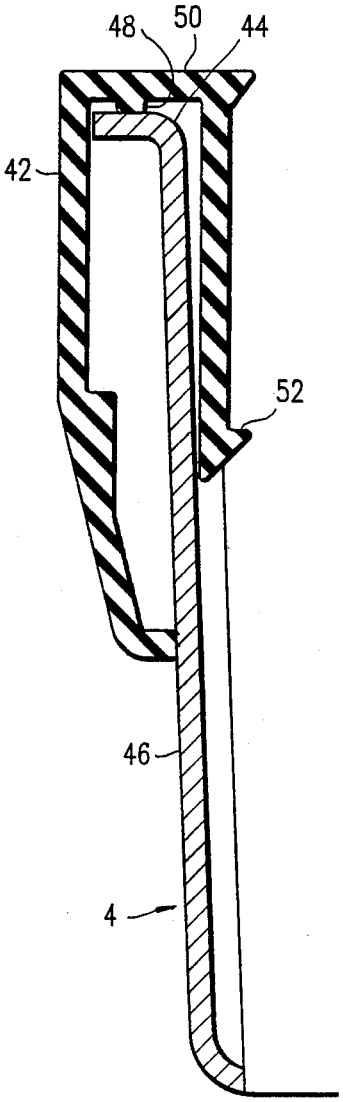
FIG. 9 is a partial cross-sectional view showing the trim member on the panel of the present invention.

The pan 4 includes a telescoping trim member 42 which, as shown in FIG. 9, is of a general U-shaped configuration and which is normally in a raised position above the reversed edge flange 44 of the pan. The trim portion 42 prior to pressing operation extends upwardly from the reversed edge flange portion 44 of the pan but, upon contact with the press head plate 28, is telescoped or shifted in a downward direction, from its raised position, along the side member 46 of the panel until a bottom portion 48 of the upper part 50 of the trim member 42 engages with the reversed edge flange 44. The trim member 42 may be provided with an inwardly projecting portion or barb 52 the upper part thereof to assist in sealing the cementitious material within the pan during pressing operation without overflow over the reversed edge flange 44 or over the trim member 42 in pressing operation. The inwardly extending projection 52 serves to both secure the trim member 42 in position and to assist in preventing the cementitious material from accidentally becoming disengaged from the pan in handling operation or subsequent installation.

As can be appreciated from a review of FIG. 9, the reversed edge flange 44 provides increased edge strength for the pan and retains the trim 42 during processing. The fact that the edge is reversed simplifies ejection from a tool during forming of the panel. Without the trim 42, the reverse flange would be impractical. Since it would be unsupported, it would be damaged during handling, and would bend under concentrated load. The flange 44 prevents the trim 42 from lifting off the pan during insertion into the mold.

Figure 4:
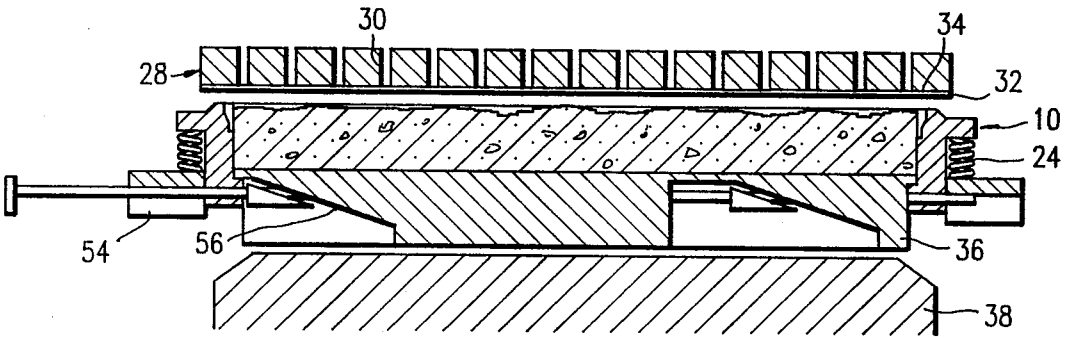
FIG. 4 shows the apparatus of FIG. 3 at the stage just prior to pressing operation.

With respect to FIG. 4, a press head forces the perforated press head plate, covered by filter media 32, down on the pan 4. The mold support springs are compressed and the packer plate 36 contacts the press bolster 38, stopping its downward movement. The pressing continues making the panel thinner and forces the water out through the filter and perforated plate. When the desired thickness is reached, pressing is stopped, and the wedges 54 are moved into position to support the thinner panel. Then the press head is raised.

Figure 5:
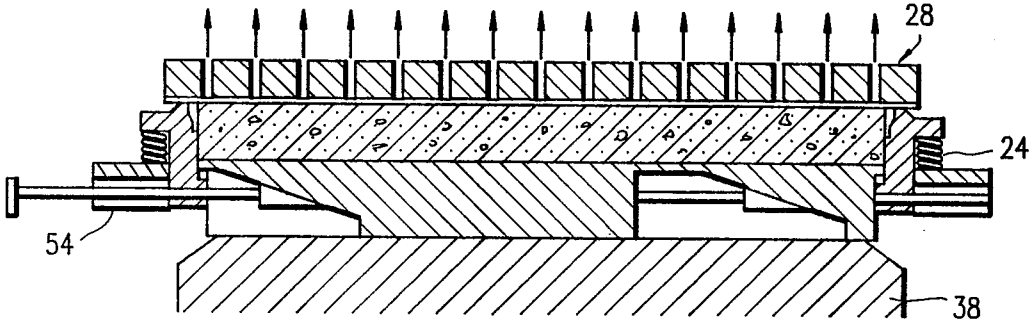
FIG. 5 shows the apparatus of FIG. 3 during the pressing stage.

As shown in FIG. 5, slidable wedge members 54 are provided which may be air or hydraulically actuated to be shiftable from the left position in FIG. 4 to a rightward position in FIG. 5 so as to engage slanted bottom portions 56 of the packer plate 36. The wedge members 54 are actuated to support the packer plate 36 after pressing operation occurs since, upon retraction of the press head plate 28, it is necessary for the packer plate 36 to shift upwardly along with the bottom portion of the steel pan 4 so as to provide support for the bottom portion of the steel pan 4 when the mold support springs 24 bias the flange portion 26 of the mold 10 in an upward direction. This means that, upon upward movement of the mold 10 due to the biasing action of the support springs 24, the packer plate 36 is also moved upwardly by the wedge members 54 so that no gap exists between the upper surface portion of the packer plate 36 and the bottom surface portion of the steel pan 4 which, lying within the mold, moves upwardly with the mold by action of the mold support springs 24 after the press head plate 28 is moved upwardly.

Figure 6:
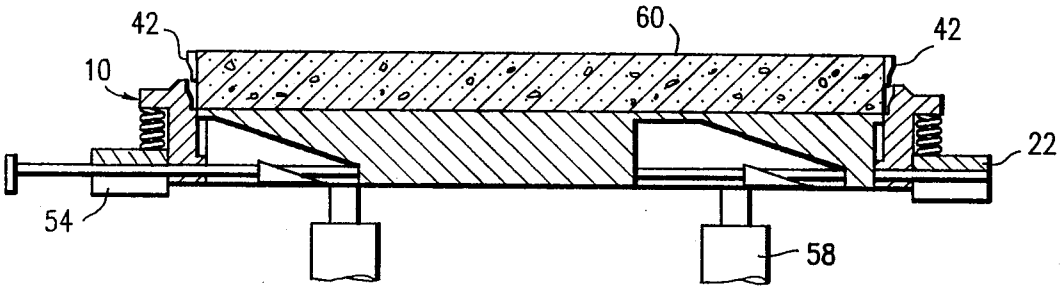
FIG. 6 shows the apparatus of FIG. 3 during an ejection stage where the panel with excess fluid removed is ready for extraction and curing.
Figure 7:
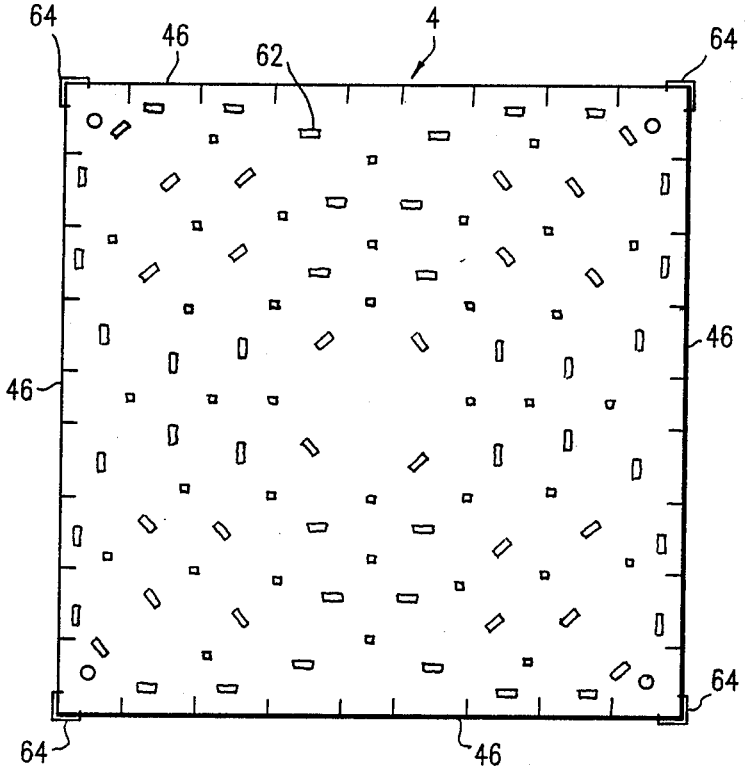
FIG. 7 is a top view of a panel produced in accordance with the present invention.
Figure 8:
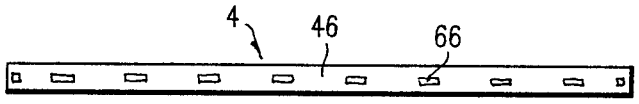
FIG. 8 is a side view of the panel of FIG. 7.

FIG. 6 illustrates the apparatus at the ejection station wherein the de-watered panel is ready for extraction and curing and the telescoping trim 42 has been securely positioned in its downward position on the side portion 46 of the steel pan.

In summary, during the pressing and de-watering process, the following steps occur:

1. The pan 4 is placed in the open mold 10 and filled to slightly less than capacity with the cementitious material 6 or similar mixture containing sufficient water or a suitable fluid to flow and level the material easily. Vibration and manual spreading of the cementitious material distribute the mix fairly evenly within the pan. This is the stage illustrated in FIG. 3. This occurs before moving to press head position (FIG. 4);

2. The mold 10 is closed by downward action of the press head plate 28, covered by the perforated filter media 32, and downward pressing action serves to press water through the apertures in the press head plate 28 by way of the filter media but which does not pass the cementitious material 6;

3. The telescoping trim 42 is forced downward by the press head plate 28 in the second step so as to be securely placed in position in fixed relationship with both the side member 46 of the panel and with the cementitious material 6 which has undergone compression;

4. The rotatable mold support table 22 then moves the mold 10 and pan 4 to an ejection position where elevating cylinders 58 are used to raise the packer plate 36 so that the de-watered panel ready for extraction and curing extends upwardly from a lower inward edge portion of the mold and therefore extend partially out of the mold.

The pressed and de-watered composite panel 60 can then be removed by conventional vacuum action by an apparatus which engages the side members for automatic removal, or can be manually removed. Raising of the packer plate 36 by the elevating cylinders 58 is controlled in an automatic manner. The de-watered composite panel 60 may then be easily handled in a relatively short time insofar as it will cure sooner and stronger with the excess water removed.

The steel pan 4 can be formed with holes 62 in the bottom thereof and corresponding apertures may be formed in the packer plate 36 so as to allow for excess water removal from the bottom portion of the pan. In this instance, a filter cloth can be placed either on the bottom of the pan 4 or in the top portion of the packer plate 36 so that water is removed without clogging the holes 62 in the bottom of the pan or the apertures in the packer plate 36. It is further noted that the steel pan can instead be made of plastic or other suitable material used in the access floor panel industry, if it is of sufficient rigidity. Also, adjacent side members 46 may be interconnected by corner clip members 64.

The de-watering process is important in that it produces high tensile strength concrete or other fluid based cementitious material (i.e., on the order of 2½ to 3 times normal concrete strength without the need for additive chemicals). This process allows for early curing of the cementitious material while providing absolutely minimal shrinkage (i.e., to the point that the shrinkage is insignificant). The panel is readily handled within 4 to 6 hours of completion of the process as compared with a requirement of at least twenty-four hours of curing where no de-watering of the cementitious material occurs and no chemical treatment is used. The resulting process is also cleaner insofar as minimal waste is generated due to precise filling of the cementitious material 6 within the panel 4 and escape of the material from the panel during the process is prevented. A further significant advantage is that the end product panel requires minimal finishing operation, if any.

The overall advantages of the present invention allow for easier handling of the materials necessary in production of the panel. As can be understood, in a high production environment such as access floor panels, handling is critical. De-watering allows the panels to be handled relatively quickly after processing for any additional processing which may be necessary or for quick curing. As a result of this invention, curing is also quicker due to the reduced water content, thus allowing for hydration to be accelerated. The de-watered cementitious material is often rigid in little over an hour.

High production molding is also possible in accordance with this invention. The relatively dry cementitious material does not stick to the mold surface and, therefore, the parts may be ejected immediately. Without de-watering, the parts would have to be left in the molds until they became sufficiently hard for separation. As a result, a large number of molds would be required for volume production, were it not for the process and apparatus used in accordance with the present invention.

The present invention also serves to allow for elimination of post-machining operation. Shrinkage is greatly reduced due to the compaction of the cementitious material. The low panel tolerances possible in the molding operation using a trim member can therefore allow for elimination of post-machining. The present invention also serves to result in a panel whose strength is increased. The lower water content during curing results in cementitious material having a much higher strength than is conventionally available.

The telescoping trim edge utilized in the present invention helps to prevent edges of the panels from chipping when a load is rolled over the panels after being installed in a floor. The deformable type trim made, for example, of plastic, allows for absorption of shocks generated on the edge portions of the panel, thus helping prevent chipping or cracking of the edge portions of the panel. The telescoping trim members also help secure the cementitious material in the pan during the pressing operation since it provides for a uniform edge along the upper part of the side members of the panels and provides for an effective seal with the filter material of the press head plate during the pressing operation. The trim member can also serve to cover holes 66 which may be formed in the side members 46 of the pan during production of the pan and therefore serve to prevent escape of either water or the cementitious material during the pressing operation. The trim member also allows for post machining, if necessary, and clearly provides for a much more aesthetically pleasing panel having a neatly finished appearance. Handling of the panel is also improved, since the edges are more durable and therefore accidental striking of the edges does not chip the concrete.

The pan with the telescoping trim attached can be inserted into the mold and filled with the cementitious material. The trim forms a seal around the lip of the mold and therefore helps assist in the development of hydrostatic pressure during the pressing operation by sealingly contacting the press head plate, thus allowing for a more effective removal of water during the de-watering and pressing step.

The cementitious material may preferably be concrete. Excess water in the concrete aids the flow and leveling of the mix, whereas minimum water results in faster cure and higher strength. Also, the remaining water becomes the variable in the process, compensating for mix variances. That is, the volume initially placed in the pan may vary, but the final concrete volume will be constant (although the pressed cement aggregrate content will then vary depending on water content). One form of concrete which can be used is a mix of Portland cement, water and industry standard expanded shale (i.e. lightweight aggregate). The aggregate may, for example, be a particular gradation meeting AST C 330-80 and C 331-81. Any aggregate could be used. However, a compressable aggregate could reduce the effect of de-watering by changing volume. A small amount of air entraining agent may be added to the mix to aid flowability, leveling, and to reduce density somewhat.

It is to be further noted that the press head and press head plate can alternatively be rigid. Then the packer plate could be pressed against the perforated plate hydraulically. In that case, the mold support springs would sit on the pressing surface and support the mold, thus keeping it tight against the perforated plate. As an alternative to the springs, urethane elastomers may be used to simplify maintenance.

The result possible with the present invention is a relatively thin panel with performance comparable to thicker panels using a similar composite structure. Thinner panels are especially desirable in access flooring, since less space is sacrificed to accommodate the floor.

Obviously, numerous modifications and variations of the present invention are possible in light of the above teachings. It is therefore to be understood that within the scope of the appended claims, the invention may be practiced otherwise than as specifically described herein.

We claim:

1. A panel, comprising:

a pan having at least one side member with an upper edge portion, said pan having contained therein a fluid based cementitious material which has undergone pressing for removal of the fluid while within the pan: and at least one telescoping trim member attached to an upper edge portion of the side member of the pan, the trim member undergoing telescoping action upon pressing of the material in the pan so as to be rigidly secured to the upper edge portion of the side members of the pan.

2. A panel as claimed in claim 1, wherein said trim member is telescopable with respect to the side member of the pan.

3. A panel as claimed in claim 1, which includes means for securing the trim member to the upper edge portion of the side member.

4. A panel as claimed in claim 1, wherein the trim member comprises means for sealing the material within the pan upon pressing of the concrete mix for removal of the fluid and which comprises a protrusion for contacting with the material.

5. A panel as claimed in claim 1, wherein said panel comprises a floor panel.

* * * * *